US005141002A

United States Patent [19]

Jeske et al.

[11] Patent Number: 5,141,002

[45] Date of Patent: Aug. 25, 1992

[54] APPARATUS FOR FEEDING TOBACCO PARTICLES TO ONE OR MORE CONSUMING MACHINES

[75] Inventors: Michael Jeske, Lüneburg; Fritz Hagemann, Hamburg; Karsten Jedamski, Moorrege; Harald Schweim, Reinbek, all of Fed. Rep. of Germany

[73] Assignee: Körber AG, Hamburg, Fed. Rep. of Germany

[21] Appl. No.: 638,100

[22] Filed: Jan. 7, 1991

[30] Foreign Application Priority Data

Jan. 8, 1990 [DE] Fed. Rep. of Germany ..... 4000312

[51] Int. Cl.[5] ..... A24C 5/14

[52] U.S. Cl. ..... 131/108; 131/109.1; 131/84.3

[58] Field of Search ..... 131/108, 109.1, 110, 131/84.1, 84.3; 285/156

[56] References Cited

U.S. PATENT DOCUMENTS

| | | | |
|---|---|---|---|
| 2,873,746 | 2/1959 | Schlossmacher | 131/109.1 |
| 3,319,772 | 3/1965 | Orlandi | 198/110 |
| 3,829,164 | 8/1974 | Schoeb | 302/28 |
| 3,832,004 | 8/1974 | Carwile | 302/18 |
| 4,756,315 | 7/1988 | Mattei et al. | 131/110 X |
| 4,887,848 | 12/1789 | Burba | 285/156 X |
| 4,889,318 | 12/1989 | Sisk | 285/156 X |

FOREIGN PATENT DOCUMENTS

| | | |
|---|---|---|
| 1107576 | 12/1961 | Fed. Rep. of Germany . |
| 1908360 | 10/1964 | Fed. Rep. of Germany . |
| 2504873 | 8/1976 | Fed. Rep. of Germany . |
| 475926 | 11/1937 | United Kingdom . |
| 784594 | 10/1957 | United Kingdom . |
| 1536922 | 12/1978 | United Kingdom . |

OTHER PUBLICATIONS

"Hauni Mixing, blending and storing of tobacco" 1983, p. 8.

*Primary Examiner*—V. Millin
*Assistant Examiner*—J. Doyle
*Attorney, Agent, or Firm*—Peter K. Kontler

[57] ABSTRACT

Apparatus for feeding tobacco particles to one or two cigarette rod making machines has a magazine with a duct having an open lower end above the upper reach of an endless belt conveyor. The conveyor can be driven to advance tobacco particles in the duct toward an outlet of the magazine where the particles are removed by one or more rotors which are driven to move the particles upwardly and away from the upper reach of the conveyor before the particles are caused or permitted to descend into a hopper. The bottom portion of the hopper admits tobacco particles into one of two suction-operated pneumatic conveyors each of which supplies tobacco particles to a discrete rod making machine. The conveyor is driven at a first speed when the hopper supplies tobacco particles to a single rod making machine, and at twice the first speed when the hopper supplies tobacco particles to two rod making machines.

6 Claims, 1 Drawing Sheet

Fig. 3
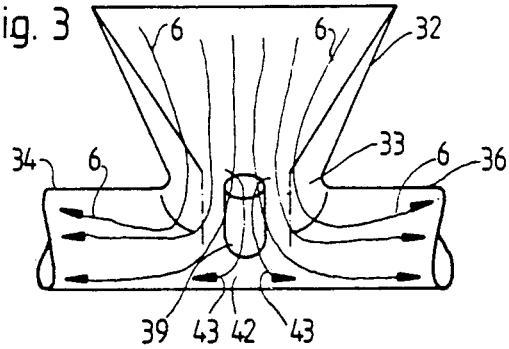
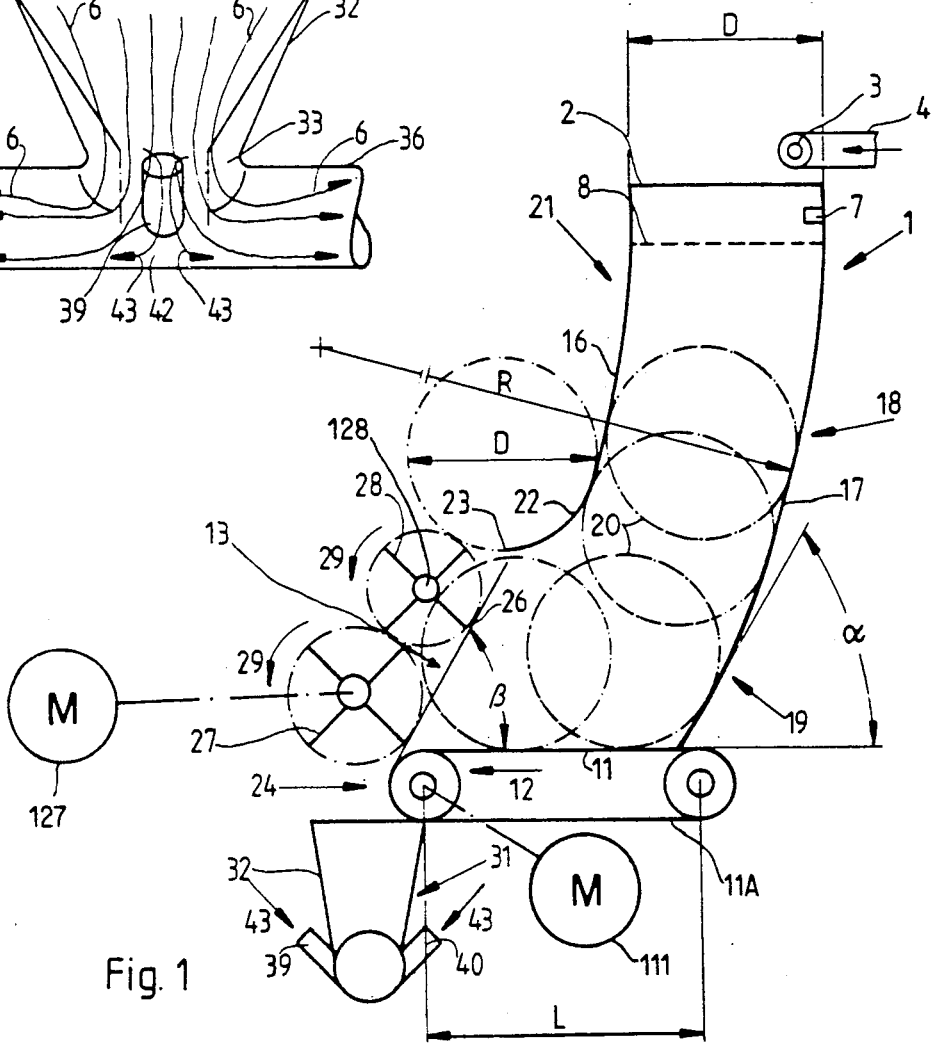
Fig. 1
Fig. 2
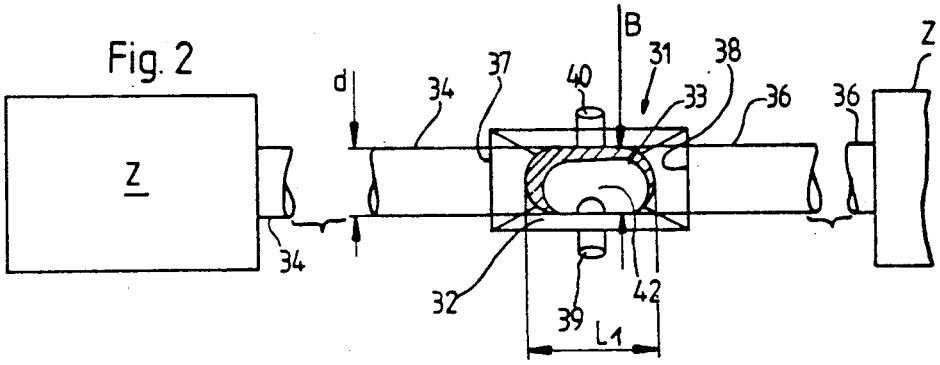

APPARATUS FOR FEEDING TOBACCO PARTICLES TO ONE OR MORE CONSUMING MACHINES

BACKGROUND OF THE INVENTION

The invention relates to improvements in tobacco feeding apparatus in general, and more particularly to improvements in apparatus for feeding comminuted natural, reconstituted and/or substitute tobacco to one or more processing or consuming machines, for example, to one or two cigarette rod making machines. Still more particularly, the invention relates to improvements in apparatus for feeding tobacco (such as shredded tobacco) which is temporarily stored in a magazine and is delivered to one or more processing or consuming machines by one or more pneumatic conveyors, especially suction-operated conveyors.

It is well known to employ pneumatic conveyors as a means for delivering comminuted tobacco from one or more magazines to the so-called distributor(s) or hopper(s) of one or more tobacco processing or consuming machines. Reference may be had, for example, to U.S. Pat. Nos. 3,319,772, 3,829,164 and 3,832,004; to British Pats. Nos. 475,926 and 784,594; to German Pat. No. 1 107 576; to published German patent application No. 25 04 873; and to German Utility Model No. 1 907 360.

OBJECTS OF THE INVENTION

An object of the invention is to provide a simple, compact and inexpensive apparatus which can be rapidly converted for predictable delivery of comminuted tobacco to one or more tobacco processing or consuming machines.

Another object of the invention is to provide a novel and improved magazine for use in the above outlined apparatus.

A further object of the invention is to provide novel and improved means for transporting comminuted tobacco from the outlet of the magazine to the intake or intakes of one or more pneumatic conveyors.

An additional object of the invention is to provide a novel and improved unit which receives comminuted tobacco from the transporting means.

Still another object of the invention is to provide a novel and improved method of preventing clogging of the receiving unit with comminuted tobacco.

A further object of the invention is to provide a novel and improved apparatus for feeding comminuted tobacco to one or more cigarette rod making machines.

SUMMARY OF THE INVENTION

The invention is embodied in an apparatus which can be utilized to supply comminuted tobacco to at least one processing machine, particularly for supplying shredded tobacco to one or more cigarette making machines. The apparatus comprises a tobacco receiving and storing magazine having a mobile bottom wall, an outlet adjacent the bottom wall and means for moving the bottom wall in a first direction to advance tobacco in the magazine toward the outlet. The apparatus further comprises means for transporting tobacco away from the outlet, and such transporting means includes at least one tobacco evacuating rotor (e.g., a vaned rotor) at the outlet and means for driving the rotor in a second direction to lift comminuted tobacco above the bottom wall in the region of the outlet. Still further, the apparatus comprises means for receiving tobacco from the at least one rotor, and such receiving means includes at least one pneumatic conveyor (for example, a suction-operated conveyor) for delivery of comminuted tobacco to the at least one processing machine.

The magazine preferably comprises at least one endless belt or band conveyor having an upper reach which constitutes the bottom wall.

The transporting means can comprise a plurality of rotors, e.g., the at least one rotor, an additional rotor and means for driving the additional rotor in the second direction, i.e., in the direction of rotation of the at least one rotor.

In accordance with a presently preferred embodiment, the magazine further comprises a duct having an open lower end above the bottom wall, a rear wall which is remote from the outlet and a front wall which is located at the outlet. The rear wall is or can be provided with a concave front side or face which is contacted by confined tobacco and faces the front wall and the outlet. The radius of curvature of the concave front side of the rear wall of the duct is preferably between 2000 and 4000 mm, particularly close to or exactly 2500 mm. The lower portion of the rear wall is adjacent to and preferably makes with the bottom wall of the magazine an obtuse angle of between 113 and 127 degrees, particularly approximately 120 degrees.

That side or face of the front wall of the duct which faces away from the rear wall is preferably a concave side, and the radius of curvature of the concave side of the lower portion of the front wall (namely of the portion adjacent the outlet and the at least one rotor) is preferably selected in such a way that it equals or approximates one-half the distance of the front and rear walls from each other. The arrangement is preferably such that the upper portion of the front wall is spaced from the rear wall a first distance which is or can be substantially constant and that the lower portion of the front wall is spaced apart from the rear wall a second distance exceeding the first distance by up to 6 percent, for example, by approximately 2 percent.

The length of the bottom wall (as measured in the first direction) can be in the range of 1.2–5 D (for example, 1.4 D) wherein D is the distance or average distance of the front wall from the rear wall of the duct.

The aforementioned moving means can include a variable-speed motor or other suitable means for moving the bottom wall at a plurality of different speeds. The arrangement is preferably such that the motor drives the bottom wall at a speed v if the receiving means includes a single pneumatic conveyor for delivery of comminuted tobacco to one processing machine, and that the motor drives the bottom wall at a speed 2 v if the receiving means comprises two pneumatic conveyors each of which delivers comminuted tobacco to a discrete processing machine, e.g., to a discrete cigarette maker of the type known as PROTOS (distributed by the assignee of the present application).

The receiving means preferably further comprises a hopper which supplies tobacco to the at least one pneumatic conveyor at a level below the bottom wall of the magazine (the entire hopper—such as a funnel-shaped hopper with an open top—can be disposed at a level below the bottom wall of the magazine). The hopper preferably includes an elongated (particularly oval or rectangular) bottom portion with two longer sides and two shorter sides alternating with the longer sides. The at least one pneumatic conveyor has an intake in one of the shorter sides of bottom portion of the hopper. If the receiving means comprises an additional pneumatic conveyor, the intake of the additional pneumatic conveyor is provided in the other shorter side of the bottom portion of the hopper.

The at least one pneumatic conveyor preferably comprises a tube having a diameter d which is preferably between 0.8 and 1.2 (for example, 1.1) times the length of the shorter sides of the bottom portion of the hopper. Each longer side of such bottom portion can have a length in the range of 1.1-1.5 d, for example, 1.3 d.

The hopper can be provided with at least one port for admission of air or another gas at atmospheric or superatmospheric pressure. The at least one port is preferably provided in one of the longer sides of the bottom portion of the hopper and is preferably designed or oriented to admit gaseous fluid substantially tangentially of the bottom portion.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain presently preferred specific embodiments with reference to the accompanying drawing.

BRIEF DESCRIPTION OF THE DRAWING

FIG. 1 is a schematic partly elevational and partly vertical sectional view of an apparatus which embodies one form of the invention and is designed to deliver comminuted tobacco to one or two cigarette rod making machines;

FIG. 2 is a plan view of the unit which delivers comminuted tobacco from the transferring means of the apparatus to one or two cigarette rod making machines, a hopper of the delivering unit being shown in a horizontal sectional view; and FIG. 3 is an enlarged elevational view of the hopper and of portions of pneumatic conveyors which receive comminuted tobacco from the hopper.

DESCRIPTION OF PREFERRED EMBODIMENTS

FIG. 1 shows an apparatus which is designed to deliver comminuted tobacco (such as shredded tobacco leaf laminae and/or ribs 6 shown in FIG. 3) to one or two cigarette rod making machines Z, e.g., to machines of the type known as PROTOS which are made and distributed by the assignee of the present application. The apparatus comprises a magazine 1 for reception and temporary storage of a preferably constant or nearly constant supply of tobacco particles. The illustrated magazine 1 includes a mobile bottom wall 11 and a substantially upright duct 18 having an open lower end adjacent and closely above the bottom wall 11. The latter constitutes the substantially horizontal upper reach or stretch of an endless belt or band conveyor 11A or a set of several endless belt or band conveyors disposed in parallel vertical planes. The inlet 2 of the duct 18 receives fresh supplies of tobacco from an endless tobacco feeding belt 4 which is trained over pulleys 3 (only one shown) and can receive tobacco from a shredding machine (not shown) or from another suitable source.

The reference character 7 denotes a conventional monitoring device which ascertains the level of the upper side of the supply of tobacco 6 in the duct 18 and controls a prime mover (not shown) for the belt conveyor 4 in order to ensure that the upper level (indicated by a horizontal broken line 8) will remain at least substantially constant. Suitable level monitoring devices (upstream of a tobacco shredding machine) are shown in commonly owned U.S. Pat. No. 4,037,712. Reference may also be had to commonly owned U.S. Pat. No. 4,220,164 and to commonly owned U.S. Pat. No. 4,759,379.

The means for moving the bottom wall 11 of the magazine 1 at a desired speed in the direction of arrow 12 comprises an electric motor 111 or any other suitable prime mover which ensures that the bottom wall 11 can advance the mass of tobacco particles toward an outlet 13 of the magazine 1. Such outlet is disposed between the front or discharge end 24 of the conveyor 11A and the lower portion 22 of the front wall 16 of the duct 18. The duct further comprises a rear wall 17 having a lower portion 19 adjacent the rear end of the mobile bottom wall 11. At least the major part of the rear wall 17 is curved in such a way that the concave front side or face of the rear wall confronts the convex rear or inner side of the front wall 16. The lower portion 19 of the rear wall 17 makes with the bottom wall 11 an obtuse angle 180° minus alpha which is preferably in the range of 113°-127°, particularly 120°. The radius (R) of curvature of the concave front side of the rear wall 17 is preferably in the range of 2000-4000 mm, for example, 2500 mm.

The upper portion 21 of the front wall 16 is preferably parallel or nearly parallel to the adjacent upper portion of the rear wall 17, and the distance D of such upper portions from each other preferably equals or approximates two radii of curvature of the concave front side or face of lower portion 22 of the front wall 16. It is presently preferred to position the walls 16 and 17 in such a way that the distance of the lower portion of the front wall 16 from the lower portion of the rear wall 17 increases, preferably gradually and preferably by up to 6 percent of D, e.g., by 2 percent. Note the phantom-line circles 20 in FIG. 1.

The lower edge 23 of lower portion 22 of the front wall 16 is closely adjacent a vaned or bladed rotor 28 of a transporting unit which serves to transport tobacco particles away from the outlet 13 of the magazine 1 and to direct the thus transported particles into the open upper end of a hopper 32 forming part of a tobacco receiving and delivering unit 31. The transporting unit further includes a second vaned or bladed rotor 27 which is disposed at a level partly beneath and to the left of the rotor 28 at the discharge end 24 of the endless belt or band conveyor 11A including the mobile bottom wall 11. The acute angle beta between an imaginary line 26 (extending between the edge 23 of lower portion 22 of the front wall 16 of the duct 18 and the discharge end 24 of the conveyor 11A) and the bottom wall 11 is preferably 49°-62°, most preferably close to 55°.

The shaft of the lower rotor 27 is driven by a variable-speed or constant-speed prime mover 127 (e.g., an electric motor). The means for driving the upper rotor 28 includes the shaft 128 which is parallel to the shaft of the rotor 27 and derives motion from the prime mover 127 or from a discrete prime mover, not shown. The directions in which the rotors 27, 28 are driven are indicated by arrows 29. It will be noted that the two rotors are mounted and driven to remove tobacco particles from the adjacent body or mass of such particles in the magazine 1 in a direction upwardly and away from the bottom wall 11. Tobacco particles 6 which are removed from the front side of the body or mass of tobacco particles at the outlet 13 of the magazine 1 are caused to descend into the open top of the hopper 32. The just described mode of mounting and driving the rotors 27 and 28 is different from heretofore known modes of driving such or similar tobacco transporting or transferring elements, i.e., one would expect the blades or vanes of the rotors 27, 28 to rotate in a clockwise direction (as viewed in FIG. 1).

The moving means 111 can comprise a variable-speed electric motor or any other suitable prime mover which is designed to move the bottom wall 11 at any one of a plurality of different speeds. The arrangement can be such that the prime mover 111 moves the bottom wall 11 at a speed v when the hopper 32 is to admit tobacco particles to a single processing or consuming (e.g., cigarette rod making) making Z, and that the prime mover 111 moves the bottom wall 11 at a speed 2 v if the hopper 32 is to supply tobacco particles to two processing or consuming machines z. The speed 2 v can constitute the maximum speed of the bottom wall 11.

It is further possible to regulate the speed of the bottom wall 11 (either gradually or stepwise) in order to account for changes in the requirements of the one and/or the other machine Z. Thus, neither the speed v nor the speed 2 v must be a constant speed.

The length L of the bottom wall 11 between the rear portion 19 of the rear wall 17 and the discharge end 24 of the conveyor 11A (outlet 13 of the magazine 1) can be in the range of 1.2 D and 1.5 D, preferably 1.4 D (wherein D is the average or the minimal distance of the front and rear walls 16, 17 from each other).

The hopper 32 of the tobacco receiving unit 31 has an elongated (oval or rectangular) bottom portion 33 with alternating pairs of shorter sides B and longer sides $L_1$. The narrower or shorter sides B of the bottom portion 33 of the hopper 32 define the intakes 37, 38 of two suction-operated pneumatic conveyors 34, 36 each of which serves to supply tobacco particles to one of the two machines Z. Each of the conveyors 34, 36 comprises a tube having an outer diameter d, and the width of each narrower side B of the bottom portion 33 is preferably 0.8–1.2 d; most preferably, d equals the length of a shorter side B. The length of a longer side $L_1$ is preferably 1.1–1.d, most preferably 1.33 d.

The manner in which the pneumatic conveyor 34 and/or 36 continuously draws tobacco particles 6 from the bottom portion 33 of the hopper 32 when the respective machine Z is on is well known and need not be described here. As mentioned above, the conveyors 34 and 36 are preferably operated with suction.

In order to prevent the gathering of a substantially conical pile of tobacco particles 6 in the bottom portion 33 of the hopper 32, the latter is preferably provided with one or two ports (the drawing shows two ports 39, 40) which serves to admit atmospheric air into the bottom portion 33 and are provided in the longer sides $L_1$ to extend substantially tangentially of the hopper 32. It has been found that such ports can effectively prevent the gathering of a conical pile of tobacco particles 6 between the intakes 37, 38 of the pneumatic conveyors 34, 36. Such piles are a cause of unpredictable delivery of tobacco particles of conventional apparatus and are even likely to completely block the evacuation of tobacco particles from the receiving unit into the tube or tubes of one or more pneumatic conveyors. The region where the streams of admitted atmospheric air influence the tobacco particles 6 in the bottom portion 33 of the hopper 32 is shown at 42 (FIGS. 2 and 3). The directions of flow of atmospheric air into the bottom portion 33 through the ports 39, 40 are indicated in FIGS. 1 and 3, as at 43.

Flow of atmospheric air into the ports 39, 40 and thence into the bottom portion 33 is induced by suction in the tubes of the pneumatic conveyors 34, 36. The likelihood of gathering of a pile of tobacco particles in the region 42 can be reduced still further by connecting the port 39 and/or 40 to a source (not shown) of compressed air. Admission of air at a pressure above atmospheric pressure might be desirable or necessary when only one of the machines Z is on, i.e., when the pressure at the intake 37 or 38 is not below atmospheric pressure.

The manner in which the rotors 27, 28 remove tobacco particles from the mass of tobacco in the magazine 1 (along the imaginary line 26) is or can be similar to that described and shown in the aforementioned commonly owned German Utility Model No. 1 907 360. However, the Utility Model does not describe or show the direction of rotation of the rotors. The drawing of the Utility Model merely indicates that a stream of tobacco particles is delivered toward the bottom wall and at the discharge end of the bottom wall beneath the lowermost rotor directly into a hopper.

The actual line of removal of tobacco particles 6 at the outlet 13 of the magazine 1 can be said to follow the outlines of the right-hand halves of the rotors 27 and 28 in FIG. 1. Reference may be had to the drawing at the bottom of page 8 in a German-language pamphlet of the assignee of the present application; the drawing shows two rotors which remove tobacco leaves from a tall accumulation or mass consisting of several superimposed layers to deliver the withdrawn leaves onto a horizontal conveyor. The outline of the front end of the mass closely follows the outlines of the two rotors which are driven to rotate in a direction to move the adjacent leaves upwardly and above the upper reach of the belt conveyor which supports the mass of tobacco leaves. Nevertheless, a stream of tobacco leaves is branched off the mass at a level beneath the lower of the two rotors.

It has been found that the left-hand halves of the rotors 27, 28 in FIG. 1 need not be overlapped by shrouds, hoods or like tobacco intercepting devices, i.e., the rotors do not or need not exhibit a sufficiently strong tendency to strew or scatter tobacco particles into the area around the open top of the hopper 32.

An important advantage of the improved apparatus is that it treats the tobacco particles gently so that the percentage of tobacco shorts in the hopper 32 is low. Furthermore, the transport of tobacco particles from the interior of the duct 18 into the hopper 32 (and thence into the pneumatic conveyor 34 and/or 36) is highly predictable. Still further, the delivery of tobacco particles to a single processing or consuming machine is just as satisfactory and just as reliable as simultaneous delivery of tobacco particles to a plurality of processing or consuming machines and vice versa. In addition, the mode of operation can be rapidly changed for delivery to a single machine or to plural machines.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for supplying comminuted tobacco to at least one processing machine, comprising a tobacco receiving and storing magazine having a mobile bottom wall, an outlet adjacent said bottom wall and means for moving said bottom wall in a direction to advance tobacco in said magazine toward said outlet; means for transporting tobacco away from said outlet including at least one tobacco evacuating rotor at said outlet and means for driving said at least one rotor in a second direction to lift comminuted tobacco above said bottom wall in the region of said outlet; and means for receiving tobacco from said at least one rotor, including at least one pneumatic conveyor for delivery of comminuted tobacco to the at least one processing machine and a hopper which supplies tobacco to said at least one pneumatic conveyor at a level below said bottom wall, said hopper having an elongated bottom portion with two longer sides and two shorter sides alternating with said longer sides, said at least one pneumatic conveyor having an intake in one of said shorter sides and said hopper having at least one air-admitting port in one of said longer sides.

2. The apparatus of claim 1, wherein said at least one port is oriented to admit air substantially tangentially of said bottom portion.

3. Apparatus for supplying comminuted tobacco to at least one processing machine, comprising a tobacco receiving and storing magazine having a mobile bottom wall, an outlet adjacent said bottom wall, means for moving said bottom wall in a first direction to advance tobacco in said magazine toward said outlet, and a duct having an open lower end above said bottom wall, a front wall at said outlet, and a rear wall remote from said outlet and having a concave side facing said front wall, said concave side having a radius of curvature of approximately 2500 mm and said rear wall including a portion adjacent to and making an obtuse angle of between 113 and 127 degrees with said bottom wall; means for transporting tobacco away from said outlet including at least one tobacco evacuating rotor at said outlet and means for driving said at least one rotor in a second direction to lift comminuted tobacco above said bottom wall in the region of said outlet; and means for receiving tobacco from said at least one rotor.

4. Apparatus for supplying comminuted tobacco to at least one processing machine, comprising a tobacco receiving and storing magazine having a mobile bottom wall, an outlet adjacent said bottom wall, means for moving said bottom wall in a first direction to advance tobacco in said magazine toward said outlet, and a duct having an open lower end above said bottom wall, a front wall at said outlet, and a rear wall remote from said outlet and having a concave side facing said front wall, said front and rear walls being disposed at a predetermined distance from each other; means for transporting tobacco away from said outlet including at least one rotor at said outlet and means for driving said at least one rotor in a second direction to lift comminuted tobacco above said bottom wall in the region of said outlet, said front wall including a lower portion adjacent said at least one rotor and having a concave side facing away from said rear wall, said concave side of said front wall having a radius of curvature which equals or approximates one-half of said predetermined distance; and means for receiving tobacco from said at least one rotor.

5. Apparatus for supplying comminuted tobacco to at least one processing machine, comprising a tobacco receiving and storing magazine having a mobile bottom wall, an outlet adjacent said bottom wall, means for moving said bottom wall in a first direction to advance tobacco in said magazine toward said outlet, and a duct having an open lower end above said bottom wall, a front wall at said outlet, and a rear wall remote from said outlet and having a concave side facing said front wall, said front wall having an upper portion spaced apart from said rear wall by a predetermined distance and a lower portion adjacent said outlet and spaced apart from said rear wall by a second distance exceeding said predetermined distance by up to 6 percent; means for transporting tobacco away from said outlet including at least one tobacco evacuating rotor at said outlet and means for driving said at least one rotor in a second direction to lift comminuted tobacco above said bottom wall in the region of said outlet; and means for receiving tobacco from said at least one rotor.

6. Apparatus for supplying comminuted tobacco to at least one processing machine, comprising a tobacco receiving and storing magazine having a mobile bottom wall, an outlet adjacent said bottom wall, means for moving said bottom wall in a first direction to advance tobacco in said magazine toward said outlet, and a duct having an open lower end above said bottom wall, a front wall at said outlet, and a rear wall remote from said outlet and having a concave side facing said front wall, means for transporting tobacco away from said outlet including a plurality of tobacco evacuating rotors at said outlet and means for driving said rotors in a second direction to lift comminuted tobacco above said bottom wall in the region of said outlet; and means for receiving tobacco from said rotors, including at least one pneumatic conveyor for delivery of comminuted tobacco to the at least one processing machine and a hopper which supplies tobacco to said at least one pneumatic conveyor at a level below said bottom wall, said hopper having an elongated bottom portion with two longer sides and two shorter sides alternating with said longer sides, said at least one pneumatic conveyor having an intake in one of said shorter sides.

* * * * *